US007229249B2

(12) United States Patent
Durocher et al.

(10) Patent No.: US 7,229,249 B2
(45) Date of Patent: Jun. 12, 2007

(54) LIGHTWEIGHT ANNULAR INTERTURBINE DUCT

(75) Inventors: Eric Durocher, Vercheres (CA); John Walter Pietrobon, Outremont (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 46 days.

(21) Appl. No.: 10/926,945

(22) Filed: Aug. 27, 2004

(65) Prior Publication Data

US 2006/0045730 A1 Mar. 2, 2006

(51) Int. Cl.
*F01D 25/24* (2006.01)
*F01D 25/28* (2006.01)

(52) U.S. Cl. ..... 415/213.1; 415/215.1

(58) Field of Classification Search ..... 415/110, 415/115, 135, 174.2, 174.5, 213.1, 215.1
See application file for complete search history.

(56) References Cited

U.S. PATENT DOCUMENTS 2,591,399 A * 4/1952 Buckland et al. ..... 60/796
3,078,071 A * 2/1963 Henny et al. ..... 415/135
3,314,648 A 4/1967 Howald
3,759,038 A 9/1973 Scalzo et al.
4,016,718 A 4/1977 Lauck
4,135,362 A * 1/1979 Glenn ..... 60/791
4,747,750 A 5/1988 Chlus et al.
5,016,436 A 5/1991 Belcher et al.
5,201,846 A 4/1993 Sweeney
5,335,490 A 8/1994 Johnson et al.
5,445,004 A 8/1995 Nannini et al.
5,472,313 A * 12/1995 Quinones et al. ..... 415/115
5,485,717 A 1/1996 Williams
5,545,004 A * 8/1996 Ho et al. ..... 415/115
5,609,467 A 3/1997 Lenhart et al.
6,012,684 A 1/2000 Umney et al.
6,109,022 A * 8/2000 Allen et al. ..... 60/223
6,286,303 B1 * 9/2001 Pfligler et al. ..... 60/805
6,463,992 B1 10/2002 Dowhan et al.
6,568,187 B1 5/2003 Jorgensen et al.
6,640,547 B2 11/2003 Leahy, Jr.

* cited by examiner

*Primary Examiner*—Edward K. Look
*Assistant Examiner*—Nathan Wiehe
(74) *Attorney, Agent, or Firm*—Ogilvy Renault LLP

(57) ABSTRACT

An interturbine duct for channelling combustion gases between two axial turbine stages. The interturbine duct is made of sheet material to provide a relatively lightweight construction.

16 Claims, 2 Drawing Sheets

LIGHTWEIGHT ANNULAR INTERTURBINE DUCT

TECHNICAL FIELD

The invention relates generally to gas turbine engines and, more particularly, to an interturbine duct construction.

BACKGROUND OF THE ART

The interturbine duct (ITD), sometimes referred to as the interstage duct, channels hot combustion gases from an axial high pressure turbine (HPT) stage to an axial low pressure turbine (LPT) stage. In multi-spool turbofan engines, the ITD is an annular duct of significant length which is typically cast integrally as a part of the LPT vane set, and thus forms in essence an extension of the LPT vane, as shown in U.S. Pat. No. 5,485,717. As gas turbine engine size decreases, the casting size becomes an increasing proportion of the engine weight, since castings cannot scale down linearly as castings can only be made reliably down to a certain minimum thickness. U.S. Pat. No. 5,016,436 discloses a double-skinned sheet metal ITD arrangement, in which cooling air is circulated between the skins to cool the hot inner skin. The double skin also provides stiffening against the dynamic forces which the ITD encounters in normal use. Such a configuration is complex and bulky, however, not to mention expensive to manufacture.

Accordingly, there is a need to provide a new lightweight ITD construction.

SUMMARY OF THE INVENTION

It is therefore an aim of the present invention to provide a new lightweight ITD having reduced wall thickness as compared to conventional cast interturbine ducts.

In one aspect the present invention provides a gas turbine interturbine duct comprising a pair of annular spaced-apart sheet metal walls extending from a first upstream axial turbine stage to a second downstream axial turbine stage of the engine, one of said walls including holes defined in at least one upstream portion adjacent the first turbine stage, the holes adapted to receive secondary cooling air and direct it around an exterior portion of at least one of the walls.

In another aspect the present invention provides a gas turbine interturbine duct comprising a pair of annular spaced-apart sheet metal walls extending from a first upstream axial turbine stage to a second downstream axial turbine stage of the engine, wherein an outer one of the annular walls is mounted at a downstream end to a vane stator of the second turbine stage and cantilevered at an upstream end.

In another aspect the present invention provides a gas turbine interturbine duct comprising a pair of annular spaced-apart sheet metal walls extending from a first upstream axial turbine stage to a second downstream axial turbine stage of the engine, wherein at least one of the annular walls includes an axially-oriented cylindrical flange portion adapted for mounting thereto a vane platform of the second turbine stage.

In another aspect the present invention provides a gas turbine interturbine duct comprising a pair of annular spaced-apart sheet metal walls extending from a first upstream axial turbine stage to a second downstream axial turbine stage of the engine, wherein an upstream end of an outer one of the annular walls is bent to provide a radially outwardly extending lip adapted for placement adjacent but unmounted to the first turbine stage.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
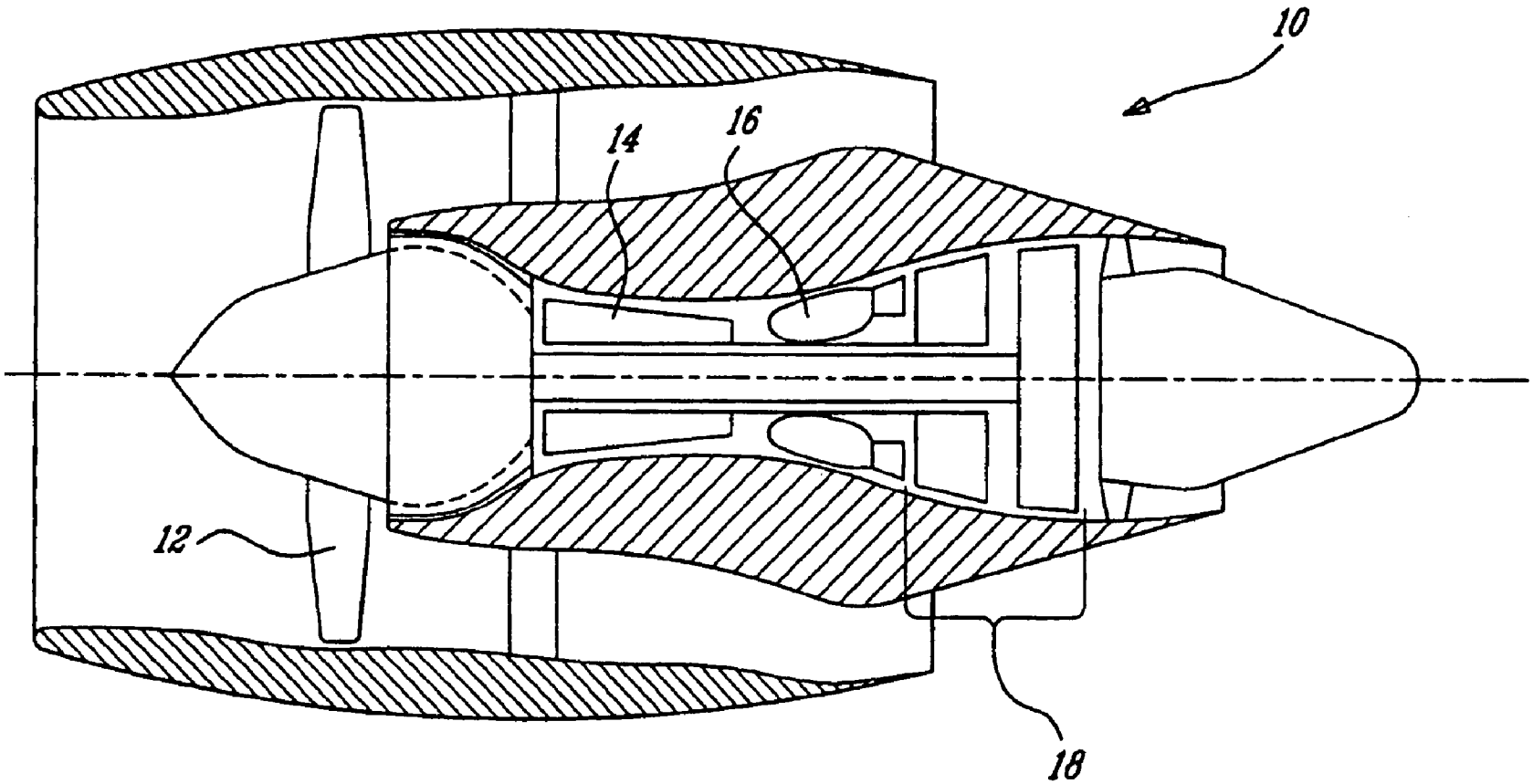
FIG. 1 is a cross-sectional side view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
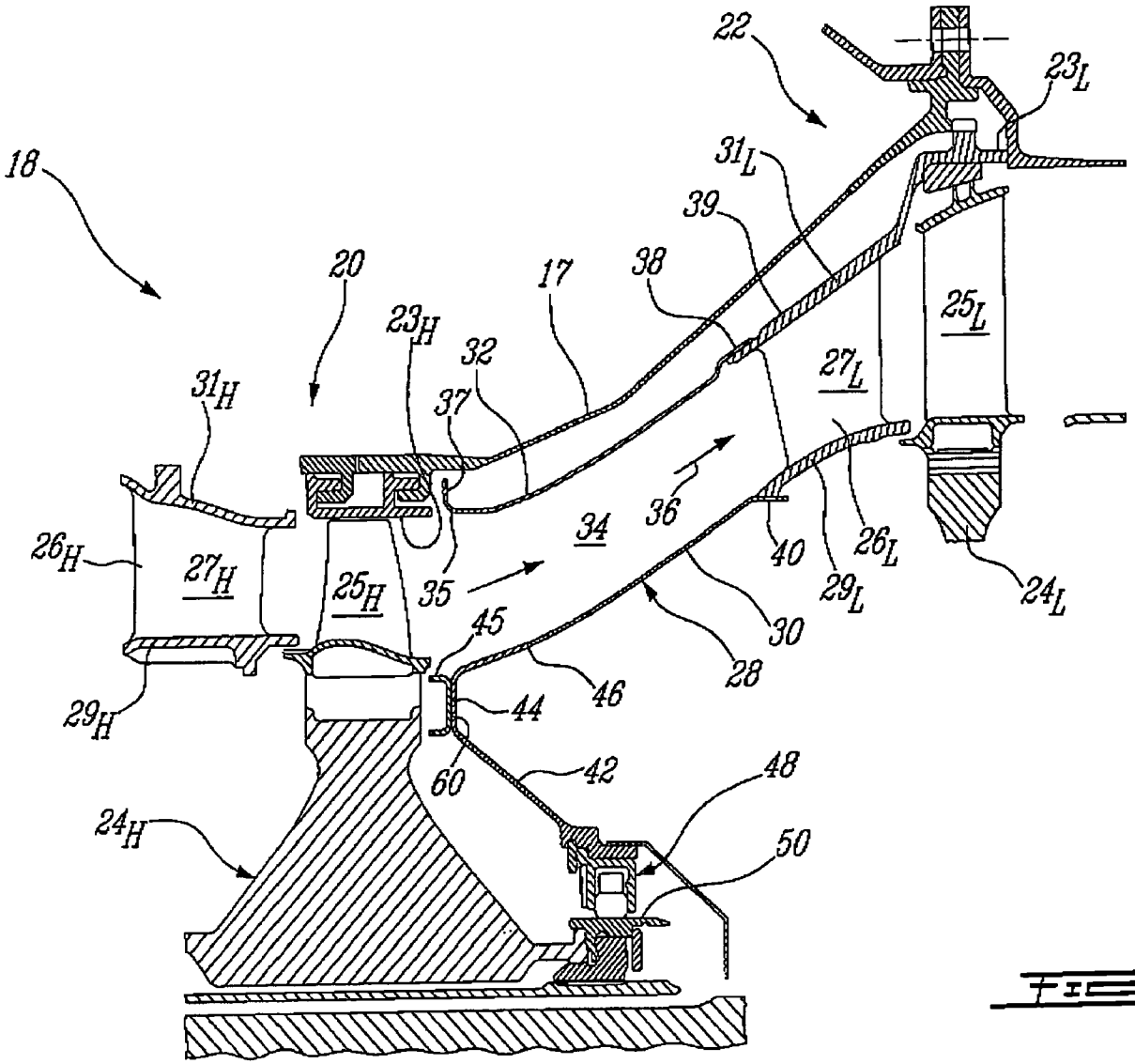
FIG. 2 is a cross-sectional side view of an interturbine duct in accordance with an embodiment of the present invention.

As shown in FIG. 2, the turbine section 18 comprises a turbine casing 17 containing at least first and second turbine stages 20 and 22, also referred to as high pressure turbine (HPT) and low pressure turbine (LPT) stages, respectively. Each turbine stage commonly comprises a shroud $\mathbf{23}_H$, $\mathbf{23}_L$, a turbine rotor $\mathbf{24}_H$, $\mathbf{24}_L$ that rotates about a centerline axis of the engine 10, a plurality of turbine blades $\mathbf{25}_H$, $\mathbf{25}_L$ extending from the rotor, and a stator vane ring $\mathbf{26}_H$, $\mathbf{26}_L$ for directing the combustion gases to the rotor. The stator vane rings $\mathbf{26}_H$, $\mathbf{26}_L$ typically comprises a series of circumferentially spaced-apart vanes $\mathbf{27}_H$, $\mathbf{27}_L$ extending radially between inner and outer annular platforms or shrouds $\mathbf{29}_H$, $\mathbf{29}_L$ and $\mathbf{31}_H$, $\mathbf{31}_L$, respectively. The platforms 29, 31 and the vanes 27 are typically made from high-temperature resistant alloys and preferably integrally formed, such as by casting or forging, together as a one-piece component.

An interturbine duct (ITD) 28 extends between the turbine blade $\mathbf{25}_H$ of the first turbine stage 20 and the stator vane ring $\mathbf{26}_L$ of the second turbine stage 22 for channelling the combustion gases from the first turbine stage 20 to the second turbine stage 22. As opposed to conventional interturbine ducts which are integrally cast/machined with the stationary vane ring $\mathbf{26}_L$ of the second turbine stage 22 (see U.S. Pat. No. 5,485,717, for example), the ITD 28 is preferably fabricated from sheet material, such as sheet metal, and brazed, welded or otherwise attached to the turbine vane ring $\mathbf{26}_L$. The sheet metal ITD 28 is advantageously much thinner than cast ducts and therefore much more lightweight. The person skilled in the art will appreciate that the use of sheet metal or other thin sheet material to fabricate an interturbine duct is not an obvious design choice due to the high temperatures and pressures to which interturbine ducts are exposed, and also due to the dynamic forces to which the ITD is exposed during operation. Provision for such realities is therefore desired, as will now be describe.

The ITD 28 comprises concentric inner and outer annular walls 30 and 32 defining an annular flowpath 34 which is directly exposed to the hot combustion gases that flows therethrough in the direction indicated by arrow 36. The inner and outer annular walls 30 and 32 are preferably a single wall of a thin-walled construction (e.g. sheet metal) and preferably have substantially the same wall thickness. According to an embodiment of the present invention, the inner and outer annular walls 30 and 32 are each fabricated from a thin sheet of metal (e.g. an Inconel alloy) rolled into a duct-like member. It is understood that ITD 28 could also be fabricated of other thin sheet materials adapted to withstand high temperatures. Fabricating the ITD in this manner gives much flexibility in design, and permits the ITD 28 to be integrated with the engine case 17 if desired. The annular walls 30, 32 extend continuously smoothly between their respective ends, without kinks, etc, and thus provide a simple, smooth and lightweight duct surface for conducting combustion gases between turbine stages.

The outer annular wall 32 extends from an upstream edge 35, having annular flange 37 adjacent HPT shroud $\mathbf{23}_H$, the flange extending radially away (relative to the engine axis) from ITD 28, to a downstream end flange 38, the flange having an S-bend back to accommodate platform $\mathbf{31}_L$ smoothly, to minimize flow disruptions in path 34. The annular end flange portion 38 is preferably brazed to the radially outward-facing surface 39 of the outer platform $\mathbf{31}_L$. The outer annular wall 32 is not supported at its upstream end (i.e. at flange 37) and, thus, it is cantilevered from the stator vane set 26 of the second turbine stage 22. The flange 37 is configured and disposed such that it impedes the escape of hot gas from the primary gas path 34 to the cavity surrounding ITD 28, which advantageously helps improve turbine blade tip clearance by assisting in keeping casing 17 and other components as cool as possible. Meanwhile, the cantilevered design of the leading edge 35 permits the leading edge to remain free of and unattached from the turbine support case 17, thereby avoiding interference and/or deformation associated with mismatched thermal expansions of these two parts, which beneficially improves the life of the ITD. The flange 37, therefore, also plays an important strengthening role to permit the cantilevered design to work in a sheet metal configuration.

The inner annular wall 30 is mounted to the stator vane set 26 of the second turbine stage 22 separately from the outer annular wall 32. The inner annular wall 30 has a downstream end flange 40, which is preferably cylindrical to thereby facilitate brazing of the flange 40 to a front radially inwardly facing surface of the inner platform $\mathbf{29}_L$ of the stator vane set $\mathbf{26}_L$ of the second turbine set 22. The provision of the cylindrical flange 40 permits easy manufacture within tight tolerances (cylinders can generally be more accurately formed (i.e. within tighter tolerances) than other flange shapes), which thereby facilitates a high quality braze joint with the vane platform.

The inner annular wall 30 is integrated at a front end thereof with a baffle 42 just rearward of the rotor $\mathbf{24}_H$ of the first turbine stage 20. The baffle 42 provides flow restriction to protect the rear face of the rotor $\mathbf{24}_H$ from the hot combustion gases. The integration of the baffle 42 to the ITD inner annular wall 30 is preferably achieved through a "hairpin" or U-shaped transition which provides the required flexibility to accommodate thermal growth resulting from the high thermal gradient between the ITD inner wall 30 and the baffle 42.

The upstream end portion of the inner annular wall 30 is preferably bent outward at a first 90 degrees bend to provide a radially inwardly extending annular web portion 44, the radial inner end portion of which is bent slightly axially rearward to merge into the inclined annular baffle 42. A C-seal 45 is provided forwardly facing on web 44, to provide the double function of impeding the escape of hot gas from the primary gas path 34 and to strengthen and stiffen web 44 against dynamic forces, etc. The inner annular wall 30, the web 44 and the baffle 42 form a one-piece hairpin-shaped member with first and second flexibly interconnected diverging segments (i.e. the ITD inner annular wall 30 and the baffle 42). In operation, the angle defined between the ITD inner annular wall 30 and the baffle 42 will open and close as a function of the thermal gradient therebetween. There is no need for any traditional lug-and-slot arrangement to accept the thermal gradient between the baffle 42 and the ITD inner wall 30. The hairpin configuration is cheaper than the traditional lug and slot arrangement because it does not necessitate any machining and assembly. The baffle 42 is integral to the ITD 28 while still allowing relative movement to occur therebetween during gas turbine engine operation. Since ITD 28 is provided as a single sheet of metal, sufficient cooling must be provided to ensure the ITD has a satisfactory life. For this reason, a plurality of cooling holes 60 is provided in web 44 for appropriate communication with an upstream secondary air source (not shown). Cooling holes 60 are adapted to feed secondary air, which would typically be received from a compressor bleed source (not shown) and perhaps passed to holes 60 via an HPT secondary cooling feed system (not shown) therethrough, and directed initially along inner duct 30 for cooling thereof. This cooling helps the single-skin sheet metal ITD to have an acceptable operational life.

The U-shaped bent portion of the hairpin-shaped member is subject to higher stress than the rectilinear portion of ITD inner wall 30 and is thus preferably made of thicker sheet material. The first and second sheets are preferably welded together at 46. However, it is understood that the hairpin-shaped member could be made from a single sheet of material.

The baffle 42 carries at a radial inner end thereof a carbon seal 48 which cooperate with a corresponding sealing member 50 mounted to the rotor 24. The carbon seal 48 and the sealing member 50 provide a stator/rotor sealing interface. Using the baffle 42 as a support for the carbon seal is advantageous in that it simplifies the assembly and reduces the number of parts.

The above description is meant to be exemplary only, and one skilled in the art will recognize that changes may be made to the embodiments described without department from the scope of the invention disclosed. For example, the ITD 28 could be supported in various ways within the engine casing 17. Also, if the stator vane set 27 is segmented, the inner and outer sheet wall of the ITD 28 could be circumferentially segmented. Still other modifications which fall within the scope of the present invention will be apparent to those skilled in the art, in light of a review of this disclosure, and such modifications are intended to fall within the appended claims.

The invention claimed is:

1. A gas turbine interturbine duct comprising a pair of annular spaced-apart sheet metal inner and outer walls extending from a first upstream axial turbine stage to a second downstream axial turbine stage of the engine, and holes defined in a transition area between the inner wall and a baffle adjacent the first turbine stage, the holes adapted to receive secondary cooling air and direct it around an exterior portion of the inner wall.

2. The interturbine duct as defined in claim 1, wherein the annular walls are brazed at a downstream end thereof to a stator vane set of the second turbine stage.

3. The interturbine duct as defined in claim 1, wherein an inner one of the annular walls has at one end thereof an axial cylindrical flange portion adapted for connection to a vane stator of the second turbine stage.

4. The interturbine duct as defined in claim 1, wherein an outer one of the annular walls is cantilevered from a stator vane set of the second turbine stage.

5. The interturbine duct as defined in claim 1, wherein the walls extend continuously and smoothly from respective upstream ends to respective downstream ends, and wherein a seal is provided on an inner face of said transition area, the holes extending through said seal.

6. The interturbine duct as defined in claim 1, wherein the transition area defines a U-shaped bent, and wherein a seal is mounted to an inner face of said U-shaped bent, the holes extending through said seal and said U-shaped bent.

7. The interturbine duct as defined in claim 6, wherein the seal has a C-shaped configuration.

8. The interturbine duct as defined in claim 1, wherein the transition area, the inner wall and the baffle form a one-piece hairpin shaped member.

9. A gas turbine interturbine duct comprising a pair of annular spaced-apart sheet metal walls extending from a first upstream axial turbine stage to a second downstream axial turbine stage of the engine, wherein an outer one of the annular walls is mounted at a downstream end to a vane stator of the second turbine stage and cantilevered at an upstream end, the downstream end having a radially inwardly facing surface brazed to a radially outwardly facing surface of the vane stator.

10. The interturbine duct as defined in claim 9, wherein an upstream end of the outer wall is bent to provide a radially outwardly extending lip adapted for placement adjacent the first turbine stage.

11. The interturbine duct as defined in claim 9, wherein the outer wall extends continuously and smoothly from the upstream end to the downstream end.

12. A gas turbine interturbine duct comprising a pair of annular spaced-apart sheet metal walls extending from a first upstream axial turbine stage to a second downstream axial turbine stage of the engine, wherein at least one of the annular walls includes an axially-oriented cylindrical flange portion adapted for mounting thereto a vane platform of the second turbine stage, the axially-oriented cylindrical flange portion having a radially facing mounting surface axially overlapping and brazed to a corresponding radially facing surface of the vane platform of the second turbine stage.

13. The interturbine duct as defined in claim 12, wherein the wall extends continuously and smoothly from an upstream end to the flange portion.

14. A gas turbine interturbine duct comprising a pair of annular spaced-apart sheet metal walls extending from a first upstream axial turbine stage to a second downstream axial turbine stage of the engine, wherein an upstream end of an outer one of the annular walls is bent to provide a radially outwardly extending lip adapted for placement adjacent but unmounted to the first turbine stage, and wherein the outer wall is provided at a downstream end thereof with a radially surface mounted in axially overlapping relation to a vane platform of the second downstream turbine stage.

15. An interturbine duct of claim 14 wherein the upstream end of the outer wall is cantilevered.

16. The interturbine duct as defined in claim 14, wherein the outer wall extends continuously and smoothly from the upstream end to a downstream end.

* * * * *